United States Patent [19]

Del Fabro et al.

[11] Patent Number: 4,993,253

[45] Date of Patent: Feb. 19, 1991

[54] DRAWING UNIT DOWNSTREAM OF A BENDING ASSEMBLY AND METHOD TO BEND THE TRAILING END OF BARS

[75] Inventors: Marcello Del Fabro, Udine; Giorgio Del Fabro, Cassacco-Fraz.Montegnacco, both of Italy

[73] Assignee: M.E.P. Macchine Elettroniche Piegatrici SpA, Reana Del Rojale, Italy

[21] Appl. No.: 463,313

[22] Filed: Jan. 10, 1990

[30] Foreign Application Priority Data

Jan. 18, 1989 [IT] Italy ..... 15904 A/89

[51] Int. Cl.[5] ..... B21D 7/022

[52] U.S. Cl. ..... 72/307; 72/388; 72/217; 72/426

[58] Field of Search ..... 72/307, 306, 388, 214–219, 72/149, 133, 419, 420, 426; 140/102, 105; 226/179–181

[56] References Cited

U.S. PATENT DOCUMENTS

| | | | |
|---|---|---|---|
| 4,388,039 | 6/1983 | Schwarze | 72/133 |
| 4,681,210 | 7/1987 | Miki | 72/307 |
| 4,766,756 | 8/1988 | Shiue | 72/294 |
| 4,885,926 | 12/1989 | Lisel | 72/426 |

FOREIGN PATENT DOCUMENTS

| | | | |
|---|---|---|---|
| 1243952 | 7/1967 | Fed. Rep. of Germany | 72/217 |
| 3436285 | 4/1985 | Fed. Rep. of Germany | 72/307 |

*Primary Examiner*—Daniel C. Crane

*Attorney, Agent, or Firm*—Antonelli, Terry, Stout & Kraus

[57] ABSTRACT

Method and machine to bend the trailing end of bars, which is to be carried out automatically or otherwise in bending-shaping machines with a working platform (22) that can be positioned as desired in relation to the horizontal and with a bending assembly located downstream of a feeding-straightening assembly for bars unwound from a reel, whereby after the required bends have been made in the leading end (T) of the bar (29), the bar (29) is fed forwards by an appreciable length at least partially by the feeding assembly with a movement of distancing of the leading end (T) and, this length of feed having been completed, the bar (29) is sheared by a shears (24) so as to create a trailing end (C) of the residual bar (129) when the trailing end (C) has been defined, the residual bar (129) is moved axially by an auxiliary drawing unit (10) located downstream of a bending assembly (35) and suitable to take up a first working position and a second retracted position to free a working platform.

12 Claims, 4 Drawing Sheets

DRAWING UNIT DOWNSTREAM OF A BENDING ASSEMBLY AND METHOD TO BEND THE TRAILING END OF BARS

This invention concerns an auxiliary drawing unit located downstream of a bending assembly in a bending-shaping machine for bars, the bending assembly being positioned downstream of at least one bar feeder unit.

Such bending-shaping machines normally work with their working platform inclined in relation to the horizontal, and this inclination may amount to 90° or more.

The invention concerns also a method to bend the trailing end of bars in a bending-shaping machine having a bending assembly located downstream of a bar feeder unit.

The bending-shaping machines to which the invention is applied are employed preferably to produce reinforcement bars comprising one or more bends in one or both of their ends.

These machines may also bend solid or hollow bars of any types with curves having a clockwise and/or anticlockwise development.

The bars which can be bent by the bending-shaping machines to which the invention is applied must be already straightened and may be unwound continuously from a reel or sheared to size.

The bar with which the invention is concerned has a substantial distance between its two ends, and such distance will not be less than at least a meter and a half in the dimensions usual for a normal bending-shaping machine according to this invention.

One type of bending-shaping machine to which the invention is applied comprises, for instance, one single bending assembly located immediately downstream of a shears and processes bars fed continuously and normally passing beforehand through a straightening assembly, which forms part of the same machine and also performs the functions of a feeder unit.

The invention is therefore applied to automatic and not automatic bending-shaping machines having a bending assembly which may comprise a bending disk able to move at a right angle to the processing direction or a bending disk stationary in relation to the working platform. Moreover, the bending disk may be axially stationary or able to move and/or rock axially.

Moreover, the bending disk may be of a type that includes only a bending pin and therefore cooperates with stationary contrast and shaping cams or may comprise the bending pin and a contrast roll solidly fixed to the centre of the bending disk itself.

The bending-shaping machines to which the invention can be applied normally process one bar at a time but can also process one or more bars at the same time.

In this invention the work "bars" means substantially filiform elements produced by rolling, extrusion, drawing or forming and having any section (round, square, rectangular, hexagonal, oval, etc.) even with outer ribs. The section of the bars may be solid or hollow.

The present appicant is not aware of the existence of bending-shaping machines having a bending assembly of the above type, in which the bar is fed continuously from reels, the machines being suitable to make automatically the required bends at both ends of a residual bar, apart from machines of a type having two or more bending heads.

By "residual bar" is meant a bar coming from a reel, straightened, possibly bent at one end and sheared to obtain a section of a required length; bends have to be imparted to the other end of the residual bar. U.S. Pat. No. 4,681,210 discloses a system for transferring presheared bars in the neighbourhood of a work station. This system is arranged above the working platform and interferes with the normal operations to bend bars; moreover, the invention is applied to simple bending machines, which process straightened bars taken from a storage point and always have their working platform substantially horizontal.

Hereinafter we shall speak of a single bar but will mean thereby that one or more bars can be bent at one and the same time by the machines according to the invention.

The auxiliary drawing unit located downstream of the bending assembly and the method which can be obtained with that drawing unit are illustrated and characterized in the respective main claims, while the dependent claims illustrate variants of the idea of the solution.

According to one embodiment of the invention an auxiliary drawing unit is provided downstream of the bending assembly at a distance determined by the axis of rotation of the bending assembly; the motor unit of this drawing unit is located below a working platform.

According to a first variant the auxiliary drawing unit according to the invention has a first vertical drawing position and at least a second vertical inactive position of non-contact with the bar. In this second vertical inactive position of non-contact the drawing unit is retracted below the upper line of the working platform.

According to one embodiment the auxiliary drawing unit is equipped with entraining rolls.

According to a variant a drawing unit with a gripper able to move in a direction along the axis of feed of the bars is provided instead of the drawing unit with entraining rolls.

According to another variant the auxiliary drawing unit comprises at least one tracked drawing means.

The auxiliary drawing unit located downstream of the bending assembly makes it possible to obtain with that bending assembly firstly the desired bends in the leading end of the bar and then to feed the bar forwards by the required length, which may be great, namely a meter and a half or more, and next to shear the bar and position it in relation to the bending assembly by means of the drawing unit so as to provide the required bends in the bar.

By means of the invention the bar can move freely on the working platform and can be processed with the working platform inclined according to requirements; moreover the bar itself does not undergo a whip effect when its second end is bent.

Let us now see a preferred embodiment of the invention with the help of the attached figures, which are given as a non-restrictive example and in which:

FIG. 1*a* shows a three-dimensional, partly cutaway diagram of a part of a possible bending-shaping machine employing the invention;

FIG. 1*b* shows a three-dimensional, partly cutaway diagram of a part of a bending-shaping machine which employs the invention but with a shears retracted;

With the help of the attached figures let us now see the application of the invention to a specific bending-shaping machine to which is fitted a given auxiliary drawing unit, although it is also possible to apply the invention also to other types of bending-shaping machines as defined earlier.

In the figures a working platform 22 is positioned horizontally but, in actual practice and in relation to the type of bends to be imparted to the bar, may be horizontal or be tilted in relation to the horizontal by even 90° or more.

In FIG. 1 a bar 29 is fed continuously from a reel and reaches a bending assembly 35 in a defined straightened condition. In this case the bar 29, while advancing, cooperates with a shears 24 located immediately upstream of the bending assembly 35.

Figure 1A:
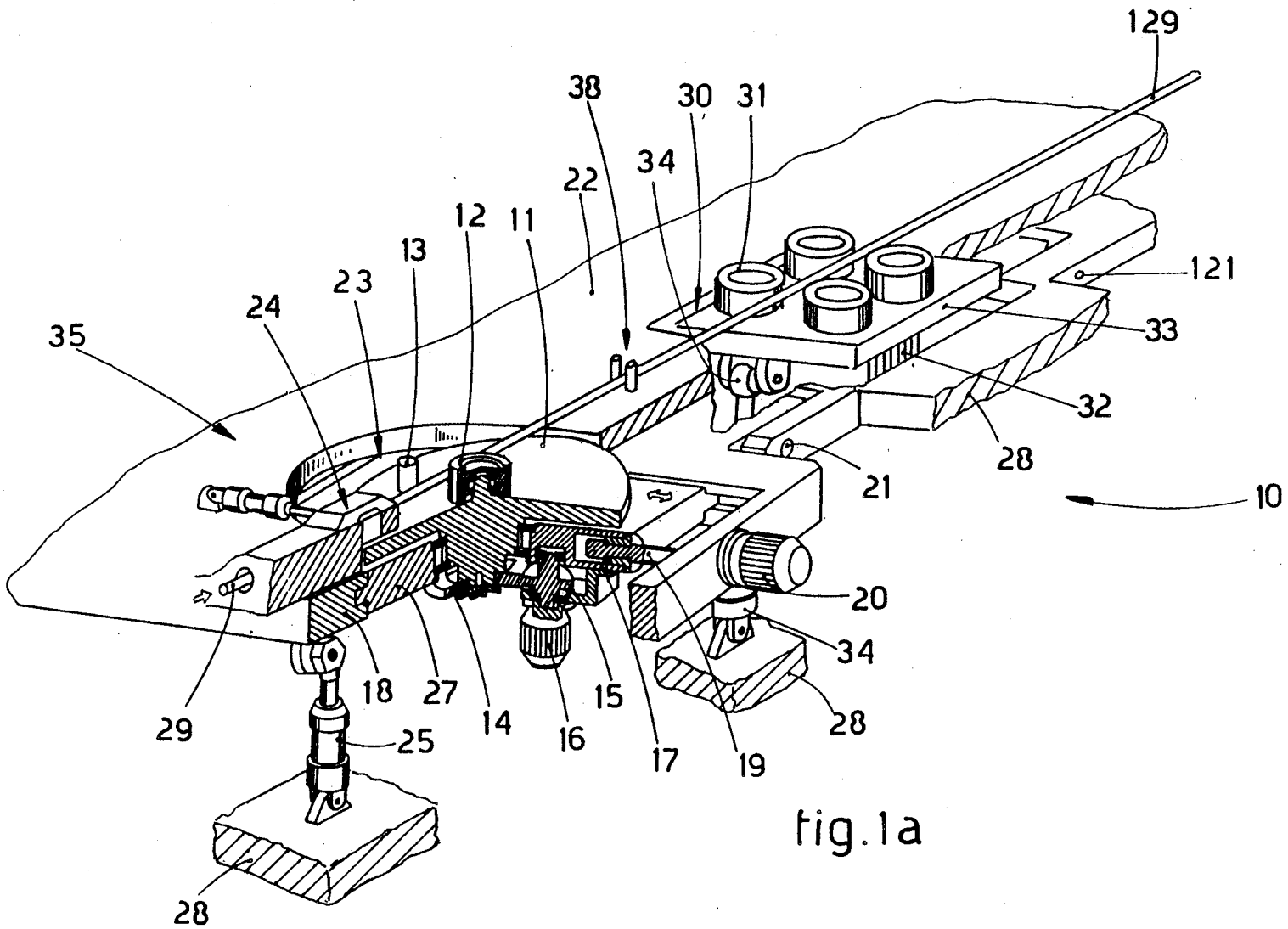
Figure 1B:
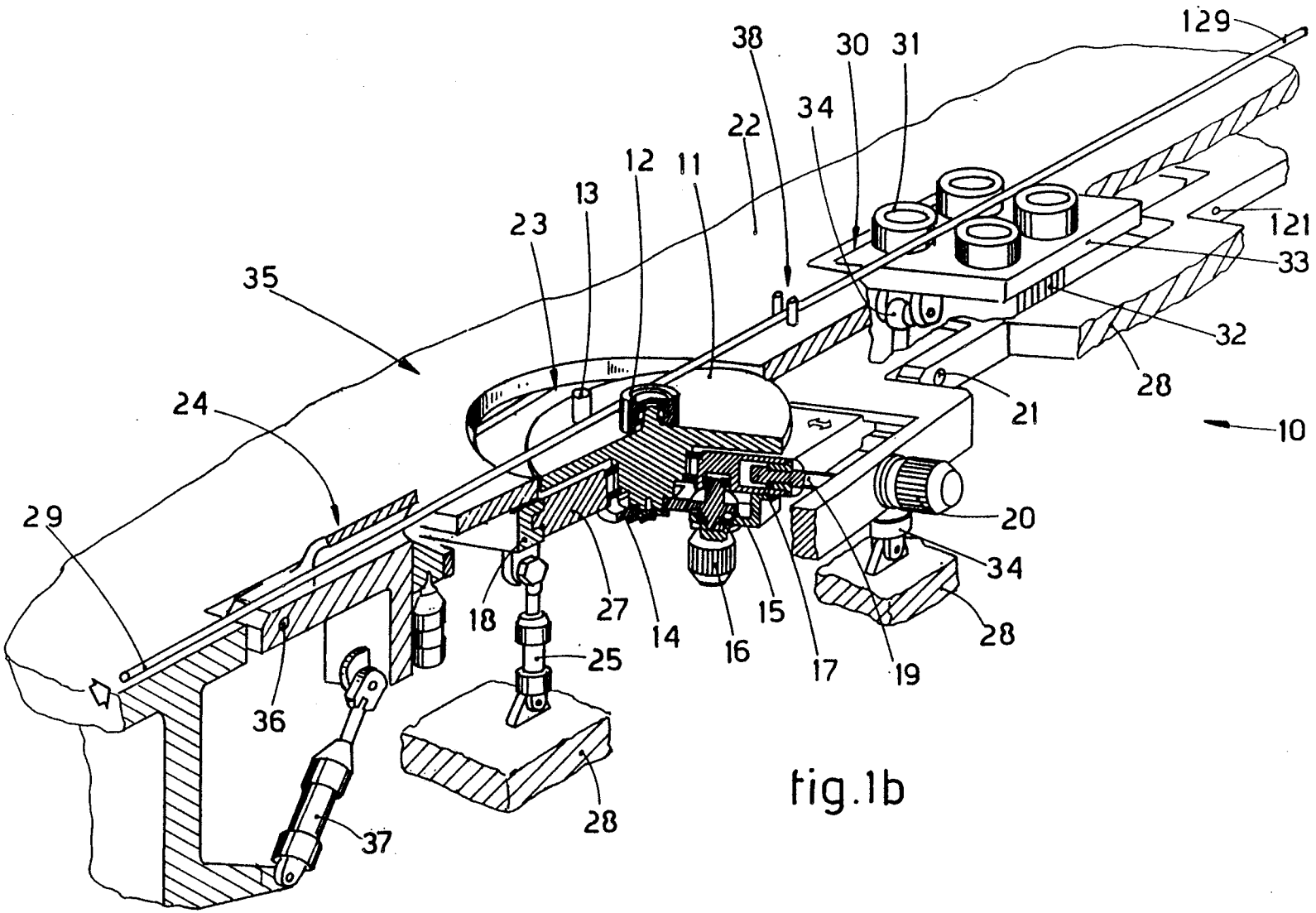

The bending assembly 35 of the type taken as an example is the subject of a parallel right of the present applicant and is shown in FIGS. 1*a* and 1*b*.

The bending assembly 35 comprises a bending disk 11 with an axial contrast roll 12 and a bending pin 13.

The bending disk 11 is supported rotatably on a slider element 27, which is able to slide on appropriate guides in a rocker base 18, and can take up in relation to that rocker base 18 at least two positions suitable for clockwise and/or anticlockwise bending respectively.

The rocker base 18 is secured to a frame 28 able to rock in a direction susbstantially normal to a working platform 22 by means of a rocker pivot 21 positioned downstream of the bending disk 11.

In this example the rocking movement of the rocker base 18 is produced by a first cylinder/piston rocker assembly 25.

The rocker pivot 21 is located downstream of the bending assembly 35 and is substantially normal to the bar 29 and parallel to the working platform 22.

The slider element 27 is actuated by a first motor 20 of any required type and the working platform 22 includes a hollow 23 suitable to lodge the bending disk 11 in the terminal position of the latter.

In the example shown the first motor 20 is of a rotary type which drives a threaded bolt 19, which by means of a threaded sleeve 17 conditions the lengthwise position of the slider element 27 within the rocker base 18.

Rotation of the bending disk 11 is obtained by means of a driven toothed wheel 14 driven by a toothed drive wheel 15, which in turn is actuated by a second motor 16.

The means providing the motion and also the transmission and/or control means are shown here as an example to make clear the method of working of the invention. They can be replaced by any other actuation, transmission and/or control means suitable for the purpose.

A pair of pins 38 having contrast functions during the bending may be comprised immediately downstream of the bending assembly 35 and will advantageously be capable of being retracted below the working platform 22 during the steps in which they are not required.

An auxiliary drawing unit 10 is included downstream of the bending assembly 35 and cooperates with the nominal axis of the bar 29 when in its working position.

In the example shown the auxiliary drawing unit 10 comprises pairs of entraining rolls 31 thrust against each other so as to mate together and draw the bar 29 actively as required.

The pressure applied by one set of entraining rolls 31 on the opposed set of rolls 31 may be resilient.

All of the entraining rolls 31 may be driven or only a part of them may be driven, for instance by a third motor 32 suitable for the purpose.

In this case the entraining rolls 31 have their axes normal to the the working platform 22 and are upheld on a support 33, which too in this case is made capable of rocking at 121 with the rocker pivot 721, which secures the support 33 to the frame 28.

The rocking movement of the support 33 is provided by a second cylinder/piston rocker assembly 34 or another suitable means such as a cam or another means.

The support 33 is accommodated within a lodgement opening 30 machined in the working platform 22; when the drawing auxiliary unit 10 is retracted fully below the working platform 22, a levelling closure means to close the lodgement opening 30 may be included advantageously to provide continuity for the working platform 22.

The support 33 can be made movable either in a rocking manner, as in the example shown, or by means of a vertical or tilted movement, for instance owing to a slider element sliding on an inclined plane.

In any event this movement is of a type suitable to position the auxiliary drawing unit 10 in two positions, one of which is a working positions whereas the other is a position of non-contact.

According to a variant a gripper able to move along the axis of feed of the bar 29 may be included instead of the entraining rolls 31 and is actuated so as to draw the bar 29 by the required length. This movable gripper may cooperate, for instance, with a stationary gripper that clamps the bar 29 temporarily in the position it has reached.

Two movable grippers may be provided instead of the stationary gripper and the movable gripper and will work alternately to eliminate the downtimes of return movement.

In the event of movable grippers too, the movable gripper must be capable of being retracted below the working platform 22 so as to avoid contact.

According to another variant, as we said above, a drawing unit having at least one tracked drawing means may be included instead of the entraining rolls 31.

Whether a movable gripper or entraining rolls 31 or tracked means are comprised, a measurement unit will be included which in any event will determine the length along which the bar 29 is drawn. This measurement unit, which is not shown here, takes into account the distance between the axis of the bending disk 11 and the position of the auxiliary drawing unit 10.

According to the variant of FIG. 1*b* the shears 24 located immediately upstream of the bending assembly 35 is capable of being retracted out of contact. We have shown as an example the case of retraction by a rocking movement below the working platform 22; in actual practice the retraction can take place sideways and below the working platform 22 by a circular movement, for instance.

Where the shears 24 are retractable, the length of the bent sides of the trailing end "C" of the bar 29 is freed of structural conditioning by the bending-shaping machine.

In the example shown the shears 24 is able to rock on its pivot 36 and the rocking movement is provided by a third cylinder/piston rocker assembly 37.

Figure 2:
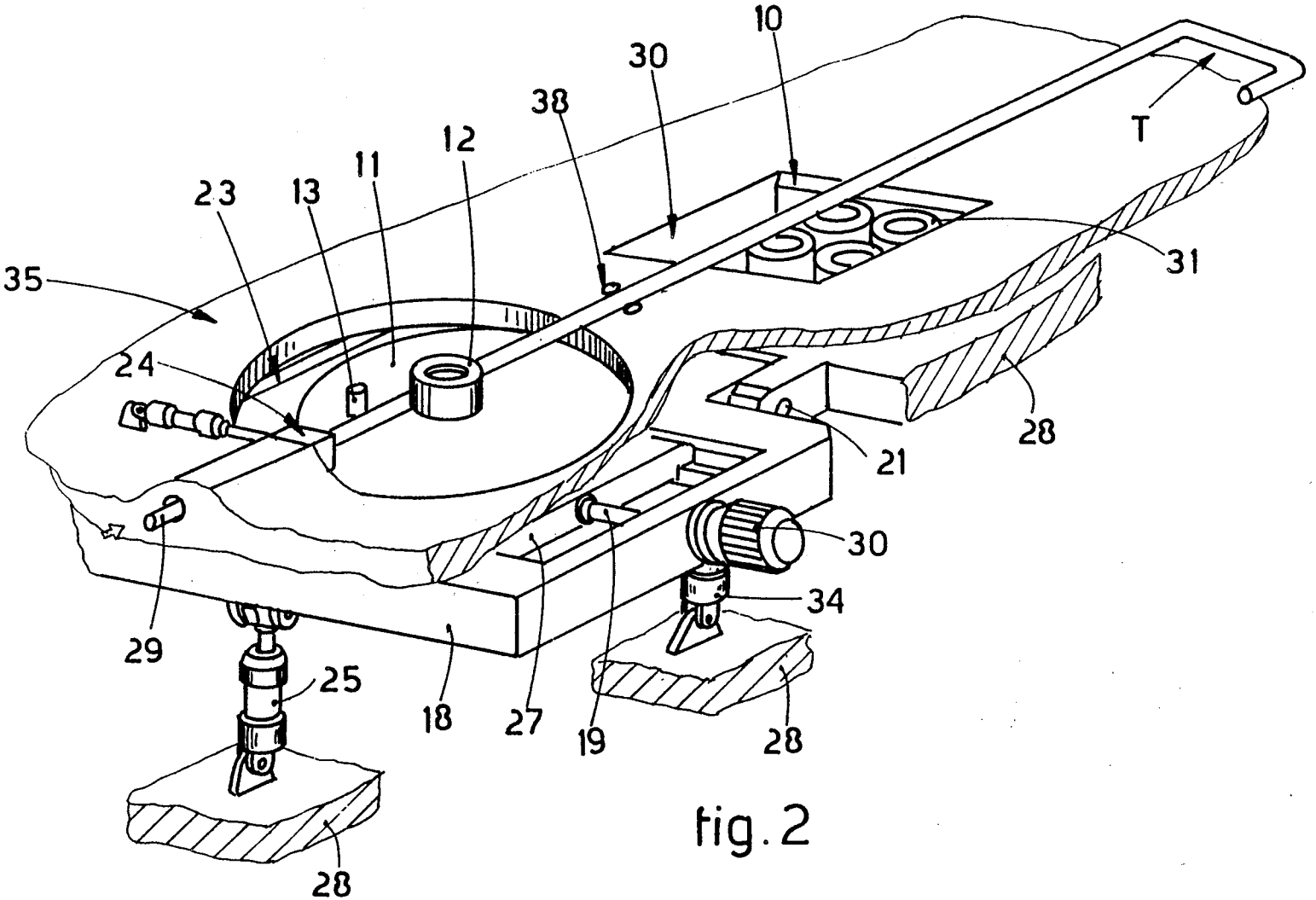
FIG. 2 shows the embodiment of FIG. 1 with some bends produced in the leading end of the bar.
Figure 3:
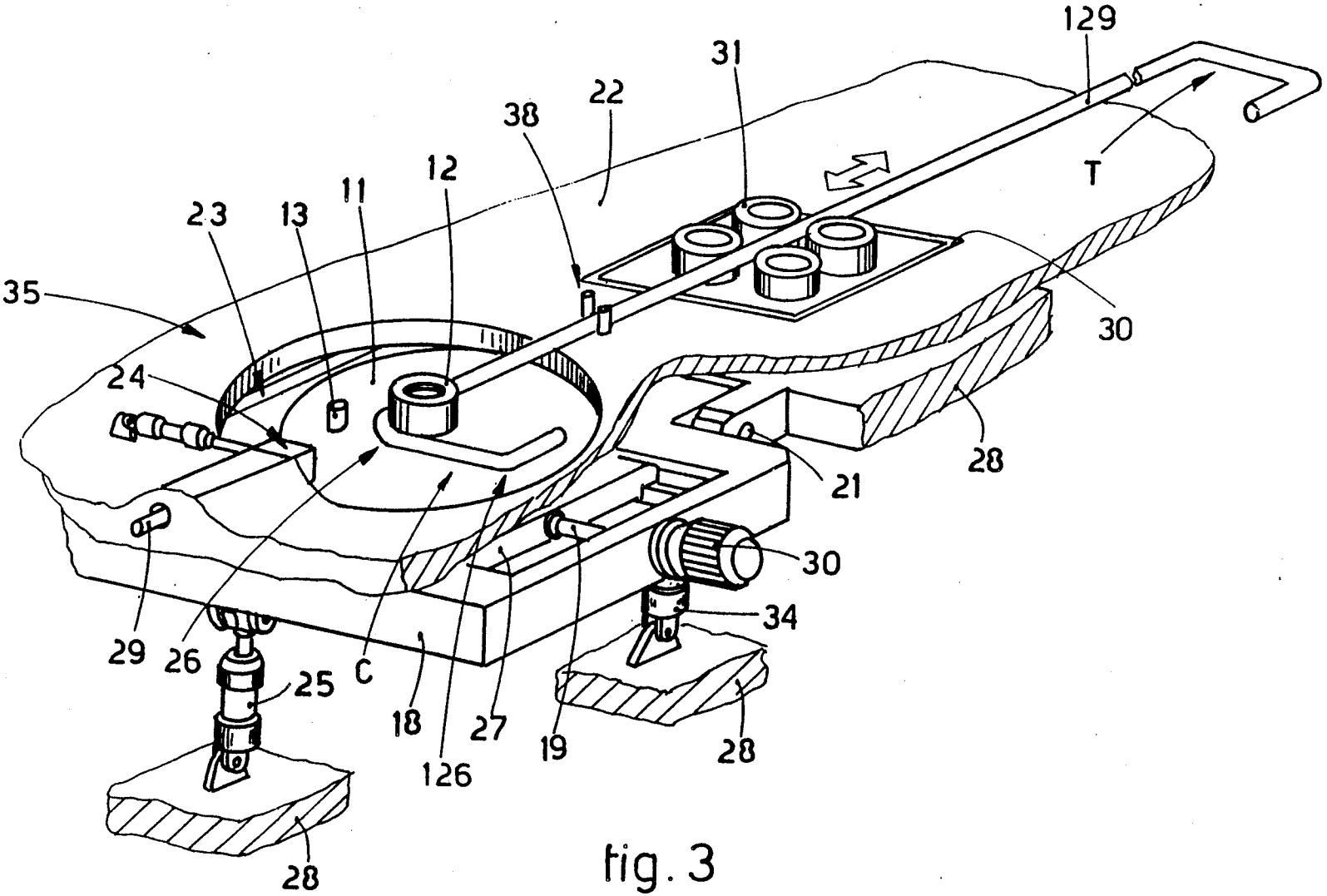
FIG. 3 shows the embodiment of FIG. 1 with a bar in which the bends have also been made in its trailing end.

As is shown in FIG. 2, the bends are performed first on the leading end "T" of the bar 29 coming from a reel and the bar 29 is then fed forward until it achieves the desired cooperation with the auxiliary drawing unit 10.

In this position of the bar 29 the auxiliary drawing unit 10 engages the bar 29 and is arranged to perform drawing when required.

The auxiliary drawing unit 10 may also be positioned while the bar 29 is being fed forward, and may engage the bar 29 while the latter 29 is moving.

When the bar 29 has been fed by the required distance, that is, when the leading end "T" is distanced from the shears 24 by a determined distance, the shears 24 shears the trailing end of the bar 29 and thus determines the residual bar 129.

In this position the drawing unit 10 positions the trailing end "C" of the residual bar 129, thus determining a first bend 26 and thereafter a second bend 126.

If the shears 24 is retractable as shown in FIG. 1*b* as an example, the length of the sides of the bends made in the trailing end "C" is left free of conditioning.

If instead the shears 24 is stationary, the maximum length of the sides of the bends made in the trailing end "C" is determined by the position of the shears 24 itself in relation to the bending assembly 35.

According to another variant, if the shears 24 is vertically stationary, it can be made to move along the axis of the bar 29 but this movement will be of a small value and serves to free the shearing head from the end of the sheared bar, thus enabling this end of the sheared bar to rotate during the bending step without making any lateral contacts.

We claim:

1. A method for bending bars in a bending-shaping machine having a working platform that can be positioned as desired in relation to the horizontal and having a bending assembly located downstream of a feeding-straightening assembly for bars unwound from a reel, said method comprising:

unwinding a bar from a reel;

straightening said bar and feeding said bar to said bending assembly with said feeding-straightening assembly;

bending a leading end of said bar with said bending assembly;

feeding said bar having a bend in said leading end at least partially with said feeding-straightening assembly so that said bar having a bend is fed past an auxiliary drawing unit located downstream of said bending assembly and positioned in a retracted nonworking position below said working platform;

shearing said bar with shears to create a residual bar having a trailing end; and then moving said auxiliary drawing unit from said retracted position below said working platform to a working position and moving said residual bar axially by said auxiliary drawing unit while in said working position; and bending said trailing end with said bending assembly.

2. A method according to claim 1, wherein said bar is engaged by said auxiliary drawing unit at least at about the moment preceding said shearing of said bar to create said residual bar.

3. A method according to claim 1 or 2, further comprising, after said shearing of said bar, retracting said shears below an upper line of said working platform.

4. A method according to claim 1, wherein said working platform is inclined from the horizontal.

5. A bending-shaping machine including a drawing unit, comprising:

a working platform which can be positioned as desired in relation to the horizontal;

a bending assembly cooperating with said working platform for bending bars;

a feeding-straightening assembly provided upstream of said bending assembly for straightening bars unwound from a reel and feeding said bars to said bending assembly; and an auxiliary drawing unit provided downstream of said bending assembly and being moveable between a working position on the axis of the bar and cooperating with said working platform and a retracted nonworking position below said working platform whereby said auxiliary drawing unit is able to axially move said bars from said bending assembly when in said working position.

6. A bending-shaping machine according to claim 5, wherein said auxiliary drawing unit comprises pairs of entraining rolls.

7. A bending-shaping machine according to claim 5, wherein said auxiliary drawing unit comprises at least one gripper able to grip said bar and to move along an axis of feed of said bar.

8. A bending-shaping machine according to claim 5, wherein said auxiliary drawing unit comprises at least one track drawing means for axially moving said residual bar.

9. A bending-shaping machine according to claim 5, wherein said retracted position of said auxiliary drawing unit is below said working platform.

10. A bending-shaping machine according to claim 9, further comprising closure means to cover said auxiliary drawing unit when said auxiliary drawing unit is in said retracted position, wherein said closure means provides continuity for said working platform.

11. A bending-shaping machine according to claim 5, wherein said working platform is inclines from the horizontal.

12. A bending-shaping machine according to claim 5, further comprising shears provided upstream of said bending assembly for shearing said bars.

* * * * *